US005273124A

United States Patent [19]

Lloyd et al.

[11] Patent Number: 5,273,124

[45] Date of Patent: Dec. 28, 1993

[54] EARTH DRILLING APPARATUS

[75] Inventors: Thomas C. Lloyd, West Pittston; Thomas C. Lloyd, Jr., Trucksville, both of Pa.

[73] Assignee: Rock Star Technology, Inc., Pittston, Pa.

[21] Appl. No.: 919,839

[22] Filed: Jul. 27, 1992

Related U.S. Application Data

[63] Continuation-in-part of Ser. No. 638,048, Jan. 7, 1991, abandoned.

[51] Int. Cl.[5] ..... E21B 3/02; E21B 7/02

[52] U.S. Cl. ..... 175/162; 173/32; 173/185; 175/122; 175/220

[58] Field of Search ..... 175/122, 162, 220, 57; 173/22, 28, 31, 32, 23, 185; 52/116

[56] References Cited

U.S. PATENT DOCUMENTS

| | | | |
|---|---|---|---|
| 2,292,867 | 8/1942 | Charles | 255/43 |
| 2,562,276 | 7/1951 | Kandle | 173/22 X |
| 2,733,896 | 2/1956 | Gunning | 173/23 X |
| 2,848,196 | 8/1958 | Simmonds | 255/19 |
| 2,904,310 | 9/1959 | Leonard | 255/22 |
| 2,955,431 | 10/1960 | Taylor, Jr. | 61/74 |
| 3,011,570 | 12/1961 | Kurt et al. | 175/122 |
| 3,146,836 | 9/1864 | Lee | 173/31 X |
| 3,205,627 | 9/1965 | Gyongyoshi | 52/115 |
| 3,220,494 | 11/1965 | Cannon et al. | 173/28 X |
| 3,527,309 | 9/1970 | Rassieur | 173/28 |
| 3,613,804 | 10/1971 | Jonnson | 173/32 X |
| 3,730,285 | 5/1973 | Anderson et al. | 175/220 |
| 3,732,935 | 5/1973 | Gibson | 173/28 |
| 3,965,628 | 6/1976 | Loftis | 52/115 |
| 4,088,289 | 5/1978 | Wood et al. | 248/2 |
| 4,099,579 | 7/1978 | Stormon | 173/31 X |
| 4,102,094 | 7/1978 | MacKinnon | 52/116 |
| 4,181,182 | 1/1980 | Gustafsson | 173/23 |
| 4,368,602 | 1/1983 | Manten | 52/115 |
| 4,371,046 | 2/1983 | Read | 175/57 |
| 4,465,144 | 8/1984 | Gugger et al. | 173/28 |
| 4,858,700 | 8/1989 | Shafer | 173/22 |

FOREIGN PATENT DOCUMENTS

| | | | |
|---|---|---|---|
| 1154420 | 9/1963 | Fed. Rep. of Germany | 175/122 |
| 98827 | 10/1961 | Norway | 175/162 |
| 617530 | 7/1978 | U.S.S.R. | 175/220 |

*Primary Examiner*—Hoang C. Dang

*Attorney, Agent, or Firm*—Eckert, Seamans, Cherin & Mellott

[57] ABSTRACT

An earth drill for use with a vehicle of a type which performs utility pole hole drilling operations is disclosed. The drill attaches to an end of a movable boom mounted on the vehicle. An elongated guide is rotatably attachable to the boom via a rotatable coupling, enabling the drill to be rotated to a convenient angle and fixed using an eccentric shear pin. A drill head is movably mounted for advance and retraction along the elongated guide. A drilling tool is attachable to the drill head and is oriented to drill a hole as the drill head is moved with respect to a ground surface. A stabilizer attached to a lower end of the elongated guide includes anchoring holes for receiving pins which are driven into the ground in order to resist transverse and rotative movement of the guide. The guide can float upwardly during a drilling operation, guided by the pins, and need not be fixed to the ground. The invention thus provides a quickly erected and effective device to drill holes of a size and at locations suitable, for example, for utility poles along the sides of highways.

20 Claims, 7 Drawing Sheets

EARTH DRILLING APPARATUS

CROSS REFERENCE TO RELATED APPLICATIONS

This application is a continuation-in-part of application Ser. No. 638,048 filed Jan. 7, 1991, abandoned.

BACKGROUND OF THE INVENTION

1. Field of the Invention

The invention relates to the field of earth drilling equipment, and more particularly, to an earth drilling apparatus attached at an end of a vehicle-mounted boom, especially to permit substantially vertical boring through hard earth, rock, or rock-like material, at a distance from the vehicle.

2. Prior Art

The electric utility industry relies heavily on overhead power lines to distribute electrical power to its various customers. High voltage power lines emanating from a generating station are strung between transmission towers. The high voltage power is stepped down to a lower voltage via transformers at an electrical substation, on utility poles, or elsewhere. Power lines carrying lower voltage power are strung between smaller utility poles and lead eventually to individual residences and businesses. Utility poles may support power lines, telephone lines, cable TV lines, etc., and similar poles may be used as pilings or footings for structures.

The utility poles typically are simply placed in the earth. The poles have a portion of their length, typically 10 percent plus 2 feet, embedded in the earth, which typically is filled or packed around the pole. The pole protrudes upwardly to provide a location for fixing cables and the like, or for attachment of structural members. Holes must be drilled in the earth to accept the embedded portion whenever a new or replacement utility pole is to be installed, and pole installation and maintenance are frequent and routine jobs for utility companies and the like. The standard pole hole must be in the range of 6 to 10 feet deep to accommodate a standard utility pole up to 17 inches in diameter at its widest part, and typically anywhere from 20 to 50 feet high.

The utility poles are commonly located at regularly spaced locations along the side of a roadway. The terrain along the side of the roadway may be flat or sloped, smooth or jagged. The earth itself may include sand, dirt, clay, broken or solid rock, or any combination of these. Often, the side of the roadway terminates in a steeply ascending or descending rock-faced cliff. It is advisable to support the utility lines at a regular spacing to avoid undue tension or an unduly low arc in the lines, and to avoid installing an unnecessary number of poles. Therefore, the utility industry has a need to drill pole holes in the earth regardless of the character and condition of the earth at the respective location.

Earth drilling bits and drives adapted for all types of material are known. The utility industry generally employs auger type drills for producing holes in loose material. The auger apparatus is mounted on a vehicle and typically includes a hydraulic motor and a helical auger bit which is rotated by hydraulic fluid pressure generated by a hydraulic pump on the vehicle. The auger apparatus may be mounted on a boom extending from the vehicle, and the boom is generally rotatable over a limited span to either side of the vehicle such that the auger can be positioned for drilling a hole anywhere within a range determined by maneuvering the vehicle and moving the boom to position the auger at a distance from the vehicle. An auger bit is not suitable for drilling through rock, broken rock or rocky soil, as the rock will quickly wear out the auger bit. Further, the auger apparatus is not suitable for drilling in steeply sloped earth because the apparatus is not supported near the auger bit, other than by the earth itself. Thus, the auger bit tends to slide downhill whenever hole drilling in steeply sloped earth is attempted.

Rock drill bits are also known. These bits may include, for example, a drilling face having one or more hardened cutting elements embedded in the face and protruding toward the rock to be cut. A percussion tool, typically operated by compressed air, is generally attached behind the rock drill bit for delivering repetitive blows through the rock drill bit to the rock. The percussion tool and the drill bit can be attached at the bottom of a drill string, all or part of which is also rotatable about an axis by a drill head attached to the top of the drill string. Rock drill bits are commonly used by water well drillers in conjunction with vehicle mounted drilling equipment. Water wells may reach a depth of several hundred feet or more, and the well drilling vehicles include a relatively tall mast so that the drill head can be raised to a height above the ground sufficient to enable long lengths of drill pipe to be inserted or removed laterally into the drill string beneath the drill head.

Water well drilling equipment is not suitable for drilling utility pole holes, which require a quick setup and only a short hole depth. Since the water wells extend much deeper than the utility pole holes, water well drilling equipment is necessarily large and expensive and is setup relatively permanently as compared to utility pole drilling needs. The tall mast may interfere with trees along the side of the roadway. Of even greater concern, in the case of hole drilling for replacement utility poles, is potentially disastrous contact between the mast and existing power lines. Further, the tall mast cannot be used as a practical matter to conveniently place a drilling apparatus over a roadway guardrail to drill a hole on the remote side thereof.

Rock drills also have been mounted on cranes, which likewise have large booms. U.S. Pat. No. 4,102,094 to MacKinnon discloses a drill mast attached at an upper end to a large boom. An adjustable brace extends between the boom and a lower part of the mast to stabilize the mast and maintain correct alignment of the mast above a hole being drilled. The mast disclosed by MacKinnon is complex and bulky and does not overcome the practical disadvantages of such apparatus with respect to the job of drilling regularly spaced utility pole holes, such as excess mast height, high cost and inconvenience.

Heretofore, attempts to employ a rock drill on a truck mounted boom of the type normally used for auger drills have not been very successful. The booms have free play in their joints and tend to flex under the load of rock drilling. As a result, the drill bit tends to walk across a surface instead of digging in, and after the hole is started the bit is easily deflected from drilling in a straight line. This results in jamming of the bit in the hole, broken bits, increased drilling time, improperly aligned holes, etc. Consequently, the standard method of drilling utility pole holes in rock is manual; that is, a man with a jackhammer breaks up the rock and the rock is removed with a shovel. This method is obviously time consuming, and a single hole may take a day or longer to drill to the required depth. There is thus a need in the utility industry for a drilling apparatus which will overcome these problems.

SUMMARY OF THE INVENTION

It is an object of the invention to provide an apparatus for efficiently drilling utility pole holes, especially in broken or solid rock.

It is another object of the invention to provide an earth drilling apparatus which can be used in conjunction with conventional utility pole hole drilling vehicles.

It is a further object of the invention to provide an earth drilling apparatus which attaches to a boom on a hole drilling vehicle.

It is yet another object of the invention to provide an earth drilling apparatus which interchangeably attaches to booms on different vehicles.

It is still another object of the invention to provide a convenient earth drilling apparatus which is more versatile than commonly used earth drilling apparatus.

These and other objects are accomplished by an earth drilling apparatus for use with a vehicle of a type which performs utility pole hole drilling operations. The vehicle has an elongated structure attached at one end to the vehicle, the other end being maneuverable, and means for providing hydraulic fluid under pressure to the apparatus through hydraulic fluid couplings. The apparatus comprises an elongated guide means having means for pivotal and rotatable attachment to the elongated structure. The pivotal attachment permits the guide means to be angled for drilling operations beyond obstructions or in sloping earth. The rotatable attachment permits the guide means to be oriented at various angles with respect to an elongation direction so that the drilling apparatus can be maneuvered to a convenient and stable position without having to maneuver the vehicle. A drill head is movably mounted for advance and retraction along at least a portion of the guide means. The drill head comprises at least one hydraulic motor for producing operative movement of a body. Means are provided for communicating the hydraulically produced forces from the vehicle to the drill head. Further means are provided for moving the drill head along the at least a portion of the guide means. A drilling tool is attachable to the drill head and is thereby oriented to drill a hole as the drill head is moved with respect to a ground surface. A stabilizer attached to a lower end of the guide means defines anchoring holes for receiving pins which are driven into the ground in order to restrain the guide means against transverse and rotative movement of the guide means. The guide means can float upwardly during a drilling operation, guided by the pins, and need not be fixed to the ground. The invention thus provides a quickly erected and effective means to drill holes of a size and at locations suitable, for example, for utility poles along the sides of highways.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
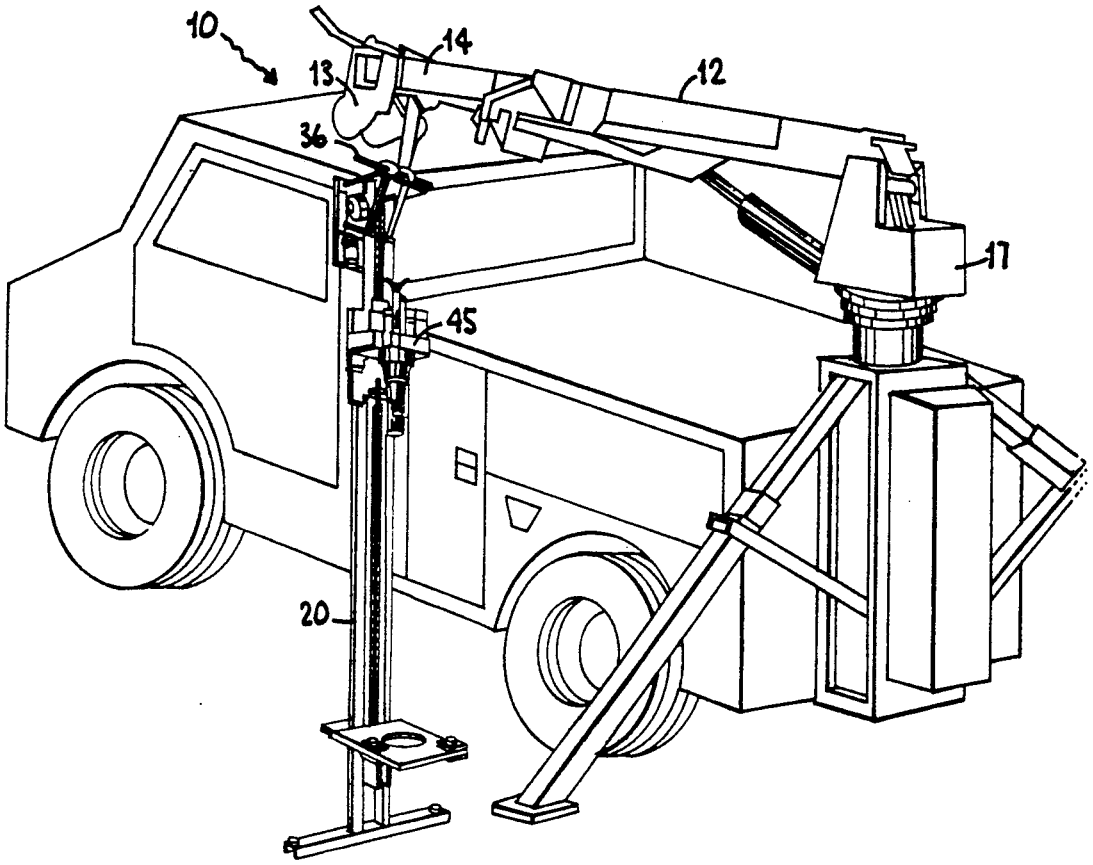
FIG. 1 is a perspective view of a drilling apparatus according to the invention, the drilling apparatus being attached at an outer end of a boom which is mounted on a vehicle.

An earth drilling apparatus according to the invention is shown generally in FIG. 1. A service vehicle of a size commonly used in the utility industry provides a mobile base for drilling utility pole holes. The apparatus includes a truck designated generally as 10 having an elongated structure, such as universally jointed boom 12, mounted on a rotatable carousel 17 at the rear of the truck. The boom 12 is preferably extensible to reduce the need for maneuvering the truck 10, for example by telescoping inner and outer portions, or by an articulating joint near a central part of the boom. The vehicle has means for providing hydraulic forces including a hydraulic fluid pump (not shown) which may be driven by the vehicle's main power source or by an auxiliary power source mounted on the vehicle. The hydraulic fluid under pressure from the pump is coupled via suitable valves to extensible cylinders and/or hydraulic motors and other actuating devices for extending, raising and lowering the boom, and for rotating the carousel. The hydraulic pumping and actuating apparatus for the boom 12 can be of the type conventionally used in boom trucks such as small cranes, cherry picker lift apparatus, etc.

The vehicle also includes hydraulic couplings for providing hydraulic forces to a drilling apparatus via couplings, valves and similar connection means. The vehicle may also have means for providing pneumatic forces, including an air compressor and an auxiliary power source for driving the air compressor. The auxiliary power source for the air compressor and the auxiliary power source for driving the hydraulic oil pump may be a single unit.

The utility industry normally employs an auger drill bit (not shown) for drilling the utility pole holes in all earth formations except for solid rock, and an auger drill can be mounted on the apparatus of the invention. The auger drill has a hydraulic motor at an upper end which is hingedly attached to one end of an arm 13. The other end of the arm 13 is perpendicularly hingedly attached to an outer end 14 of the boom 12. Thus, the arm 13 defines a form of universal joint mounting whereby the auger drill can be inclined from vertical in order to drill the pole holes at any desired angle. Of course the usual pole hole is precisely vertical. Nevertheless, inclined holes may be needed as well, for example to anchor a diagonal bracing pole, etc The drilling apparatus according to the invention can be operated by removing the auger drill from the commonly used drilling vehicle from which the auger dangles without support, and attaching a drill support and powering device as hereinafter described. The auger drill is easily detached by a skilled mechanic using ordinary hand or power tools to remove attaching hardware. In order to retain the universal joint function of the arm 13, it is preferred to detach the auger drill where the hydraulic motor connects to the one end of the arm.

Figure 2:
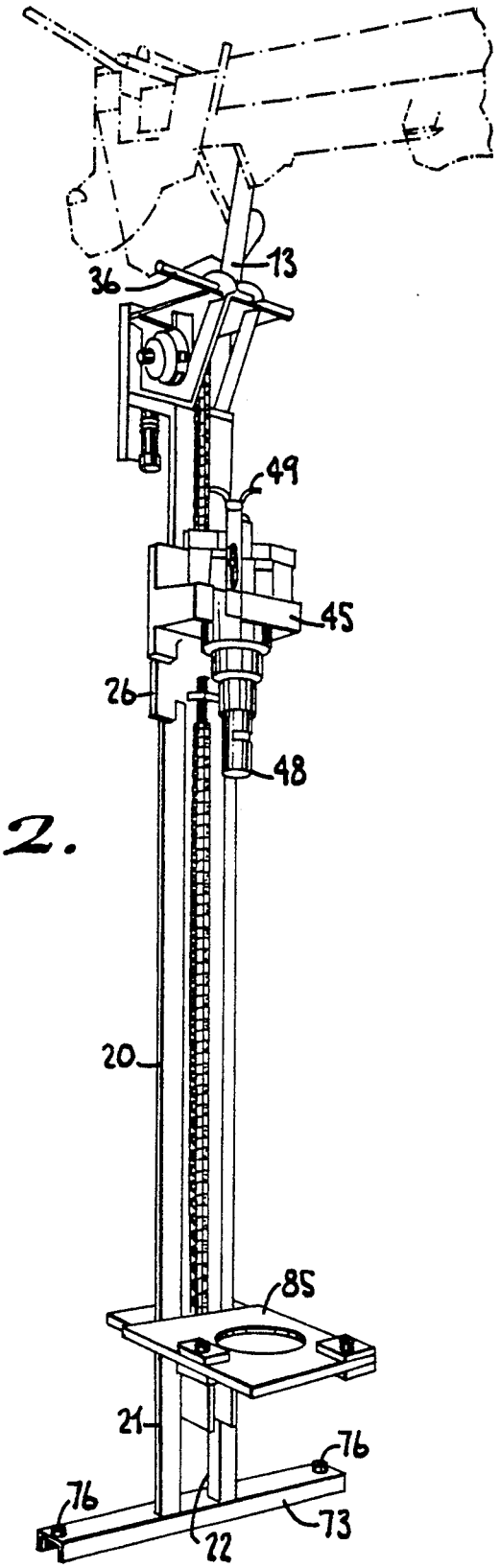
FIG. 2 is a perspective view of the drilling apparatus before attachment of a drill pipe and a drill bit.

As shown in FIG. 2, the earth drilling apparatus of the invention includes an elongated guide means 20 which preferably includes two lengths of angle iron 21, 22 having suitable size and strength to form a rigid structure to support and guide the drilling means. The lengths of angle iron 21, 22 are rigidly connected in either contacting or laterally spaced apart relationship as necessary to achieve desired dimensions. In the preferred embodiment shown, angle irons 21, 22 are laterally spaced and the space protectively accommodates part of the structures used to raise and lower the drilling means. The angle irons may be connected by bolting, welding, or other suitable means or by similarly connecting angle irons 21, 22 to end members and/or intermediate transverse members. The guide means 20 defines an elongation direction extending along a major length of the guide means which, as shown in FIGS. 1 and 2, is vertical when the guide means is disposed perpendicular to a horizontal ground surface.

Figure 3:
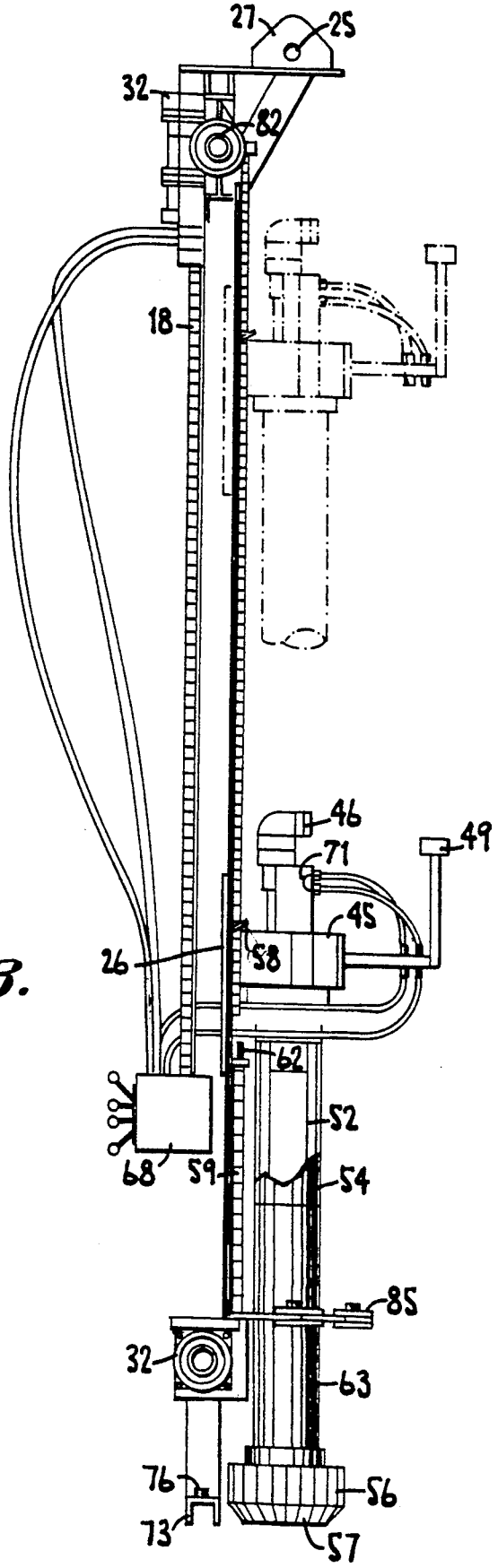
FIG. 3 is a side view of the drilling apparatus with the drill pipe and the drill bit, the drill head being shown in raised (broken lines) and lowered (solid lines) position.

According to the invention, the guide means 20 is removably attached to the boom 12. Preferably, the guide means is removably attached to the one end of the arm 13 (the lower or distal end), mounted on the boom 12. As shown in FIG. 3, an upper end of the guide means defines a bore 25 for receiving a transverse shaft, namely support bar 36, shown in FIGS. 1 and 2. The upper end of the guide means may include a pair of spaced apart ear members 27 defining a pair of coaxial holes which form the bore 25 for the support bar 36. The holes may be coaxially aligned on either side of a corresponding bore in the one end of the arm 13. The support bar 36 is insertable through the coaxially aligned holes which form the bore 25 and through the corresponding bore in arm 13 for suspending the guide means as shown in FIG. 2. The support bar may be retained with locking means such as cotter pins, C-clips, or the like. In this manner the guide 20 is fixed to arm 13 for lateral positioning of guide 20, but is pivotally movable relative to the boom 12.

Figure 6:
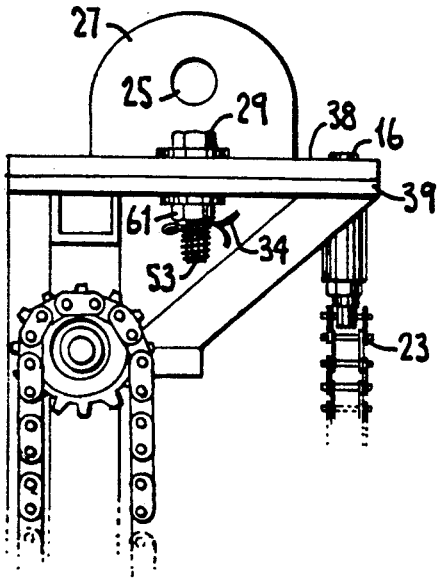
FIG. 6 is a close-up elevation view of an upper end of the drilling apparatus.
Figure 7:
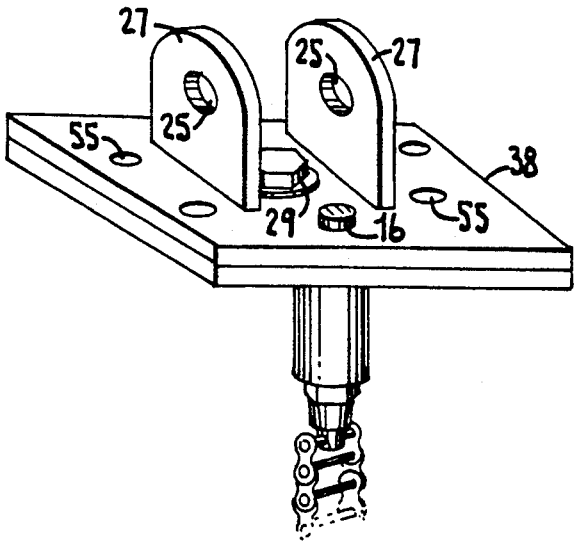
FIG. 7 is a top perspective view of a means for rotatably attracting an upper end of the drilling apparatus to a vehicle.

The upper end of the guide means is rotatably attached to the boom. Referring now to FIGS. 2, 6 and 7, a means for rotatably attaching an upper end of the guide means includes an upper coupling member 38 attached to the boom 12 such as by the support bar 36. The upper coupling member 38 is a substantially planar member having ear members 27 attached thereto. A substantially planar lower coupling member 39 is firmly attached to the upper end of the guide means such as by welding or bolting. The upper and lower coupling members are relatively rotatable on a central shaft 53 which may be defined by a shank or bolt 29. Castellated nut 61 threadedly secures the bolt 29 without tensioning, i.e., the bolt 29 is loosely retained in a bore through the upper and lower coupling members 38, 39 so that the bolt 29 does not frictionally restrain relative rotation of the upper and lower coupling members. The castellated nut 61 is prevented from unthreading from the bolt 29 by cotter pin 34 disposed in a hole through the shank of the bolt 29.

Figure 8:
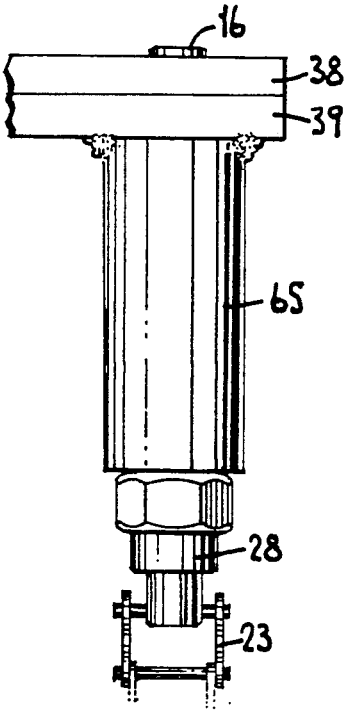
FIG. 8 is a view of a rod means for selectively engaging apertures in the means for rotatably attaching.

Prior to a drilling operation, the drilling apparatus may be oriented in a most favorable position for drilling in a hillside and/or beyond an obstruction by combined movements of pivoting the guide means 20 on the support bar 36 and rotating the guide means 20 on an axis defined by the shaft 53 which extends parallel to the elongation direction of the guide means. Means are provided for selectively retaining the guide means in a particular orientation with respect to the upper coupling member 38. In a preferred embodiment as shown in detail in FIGS. 7, 8 and 9, the upper coupling member 38 defines a plurality of apertures 55 eccentric to the axis of the shaft 53 and disposed in a circle around the axis. A rod 16 is selectively engageable in any of the plurality of apertures 55 to prevent relative rotation of the upper and lower coupling members. The rod 16 is connected to the lower coupling member 39 and disposed parallel to the shaft 53 at a radius which is the same as a radius of the plurality of apertures 55 from the shaft 53. The rod 16 is biased to engage one of apertures 55 such as by spring 24, shown in FIG. 9, and the rod 16 can be withdrawn from engagement in the apertures 55 by pulling downwardly on operating cable or chain 23 which is connected to a lower end of the rod 16 and extends toward the ground for manipulation by operating personnel. When the rod 16 is withdrawn from one of the apertures 55 such that the top portion of the rod 16 resides below the upper coupling member 38, the guide means 20 is free to be rotated about the axis defined by the shaft 53. The rotation of the guide means 20 is preferably performed by operating personnel who manually urge the guide means 20 to a desired orientation, although means for supplying powered rotation such as by hydraulic actuators should be readily apparent to those skilled in the art. As the guide means 20 is rotated, the rod 16, which is connected to the lower coupling member 39, will successively align with different ones of the apertures 55. When a desired orientation of the guide means 20 is achieved, the rod 16 can be released to engage in the aligned one of the apertures 55 by releasing the chain 23, thereby preventing relative rotation of the upper and lower coupling members. The plurality of apertures 55 may be any number of apertures which may be defined in the upper coupling member without substantially weakening the structure of the coupling member. Of course, the greater the number of the apertures 55, the greater the number of orientations to which the guide means 20 can be adjusted. It has been determined that eight apertures 55 is an appropriate number, thus providing selectable orientations of the guide means in 45° increments of rotation. It should be understood that the apertures 55 could be disposed in either one of the upper and lower coupling members, the rod 16 being movably mounted on the other of the upper and lower coupling members.

Figure 9:
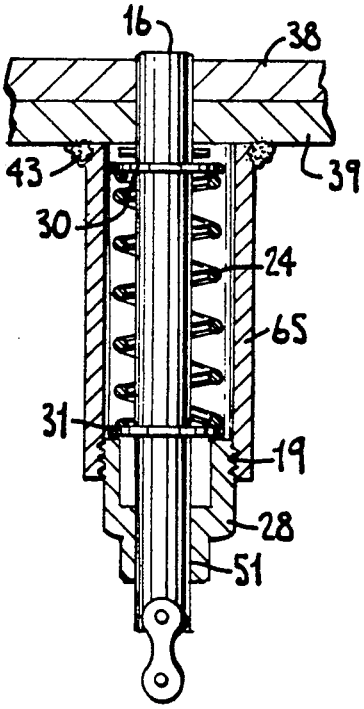
FIG. 9 is a cross-sectional view taken along line 9—9 of FIG. 8.

A preferred embodiment of the means for selectively engaging the rod 16 in the plurality of apertures 55 is shown in detail in FIG. 9. The rod 16 and the spring 24 are disposed within tubular member 65 which may be, for example, a pipe coupling having on end connected to the lower coupling member by weld 43 and having screw thread 19 at an opposite end. A pipe plug 28 threadedly engages with the screw thread 19. The pipe plug 28 has a hole 51 drilled through a center portion wherein a length of the rod 16 resides. A pair of washers 30, 31 are disposed over the rod 16 at opposite ends of the spring 24. The washer 31 rests on an end of the pipe plug 28. Roll pin 35 is disposed in a hole in the rod 16 between the lower coupling member 39 and the washer 30. The roll pin 35 rests on the washer 30, which is supported by the spring 24, and the roll pin 35 prevents the rod 16 from falling out of the aperture 35 due to gravity. The roll pin 35 also acts on the washer 30 to compress the spring 24 when the chain 23 is pulled downwardly. The spring 24 maintains the rod 16 in engagement with the aperture 55 with which it is aligned.

Referring now to FIGS. 2 and 3, a drill head 45 is movably mounted to be advanced or retracted along at least a portion of the guide means. In a preferred embodiment, a plate means 26 is movably attached along the guide means, and the drill head 45 is attached to the plate means such as by threaded fasteners. The drill head has at least one hydraulic motor and can be a standard drill head for rock drilling operations such as is commonly known in the drilling industry. The plate means 26 defines a pair of opposed internal grooves which are dimensioned to slidingly receive oppositely extending legs of the angle irons 21, 22. The plate means 26 may be formed by parallel plate members joined and appropriately machined to define the opposed grooves between mating surfaces of the plate members. Alternatively, the plate means may be an integral part of the drill head. The drill head includes a rotatable shaft 48 which may be attached in a known manner to a drill pipe 52, and receives a rock drill bit 56 at a remote, or lower, end thereof. The rock drill bit is of a type known in the drilling industry and includes a drilling face 57 having a plurality of, for example, tungsten carbide or other hard inserts embedded in the drilling face and protruding therefrom toward the material to be drilled. The drill bit 56 has a central passageway for conveying a flow of air to the drilling face 57 in order to clear the hole of drilling debris as hereinafter described. The drill bit as shown is oriented to drill a hole vertically downward as the drill bit is moved toward the earth formation. However, as noted above, the guide can be inclined.

The drilling apparatus may also include a percussion tool 63 attached between the rock drill bit 56 and the drill pipe 52 for producing a reciprocating motion of the drill bit while the drill bit is rotating. The drill bit thus cuts and pulverizes the rock in a single operation, thereby decreasing drilling time as compared to the same drilling apparatus without the percussion tool. The percussion tool may be of a type which is generally known in the drilling industry. Known percussion tools typically require a source of pneumatic pressure for their operation. For this purpose the percussion tool can be connected to an air compressor mounted on the vehicle. An air hose is connected at one end to an output from the air compressor, and at the other end to an air inlet fitting 46 on the drill head 45, for example, with snap-on couplings, threaded connectors, etc. An air hose support 49 is provided to reduce bending stress at the fitting 46 due to the weight of the air hose, and to maintain the air hose clear of the drilling apparatus. Each of the drill head 45 and the drill pipe 52 has a central passageway through which air flows to the percussion tool, and further flows through the central passageway in the drill bit 56 before exhausting from a central aperture in the drilling face 57. The air hose between the truck mounted air compressor and the air inlet fitting 46 can run along the boom 12 or can be run directly, for example along the ground.

The percussion tool 63 has an external diameter which is greater than an external diameter of the drill pipe 52. Therefore, sleeve 54 is preferably attached at an upper end of the percussion tool. The sleeve 54 is a hollow pipe which has an external diameter substantially the same as the external diameter of the percussion tool. The sleeve 54 is disposed external to and coaxial with the drill pipe 52. The sleeve 54 and the percussion tool 63 define an outer surface of constant diameter from the drill head 45 to the rock drill bit 56. Thus, as a hole is drilled in the earth, an annular space of constant cross-section is defined between the drill string outer surface and the wall of the hole. Air which is exhausted at the drilling face 57 gathers drilling debris at the bottom of the hole and forces the debris through the annular space up to the ground surface. The constant cross-section of the annular space causes the air and debris to be maintained at a high velocity so that the debris does not fall back down the hole.

Means are provided for communicating the hydraulic forces from the vehicle to the drill head. Hydraulic hose means are attached at one end to the hydraulic fluid couplings on the vehicle, and at the other end to hydraulic fittings 71 on the drill head. Control means are provided for controlling the hydraulic forces to the drill head. The control means preferably include a plurality of hydraulic pressure control valves 68 which are attached to brackets supported by the guide means in a location to allow a drill operator to stand next to the guide means for optimum viewing of the hole being drilled. Safety shut-off means or pressure relief means, etc., can also be included Means for restraining a lower end of the guide means are provided in order to resist transverse and rotative movement of the guide means relative to the drilling axis. The means for restraining may include anchoring holes in the lower end of the guide means for receiving pins to be driven through the anchoring holes into the ground. A preferred embodiment for the means for restraining as shown in FIGS. 2 and 3 includes a stabilizer bar 73 attached rigidly to the lower end of the guide means. The stabilizer bar has at least two sleeves 76 adapted to receive a pin, dowel or the like, which is hammered or threaded into the ground. The at least two sleeves 76 each have an axis which extends parallel to the elongation axis of the guide means. The sleeves may be formed from short lengths of pipe or the like.

Prior to starting a drilling operation, the guide means is positioned at the pole hole to be drilled. The at least two sleeves are used as templates for locating the dowels in the ground. When the ground has a sufficient top layer of soil, the dowels may simply be inserted through the sleeves and hammered into the ground. The dowels are preferably formed from lengths of pipe having a diameter smaller than an inside diameter of the sleeves, and can be as long as necessary in view of the character of the earth into which the dowels are passed to fix the bottom of the guide means in place. When the top layer of soil above rock is very shallow, portable rock drills may be used to drill pilot holes in the rock before the dowels are hammered into the earth.

Figure 4:
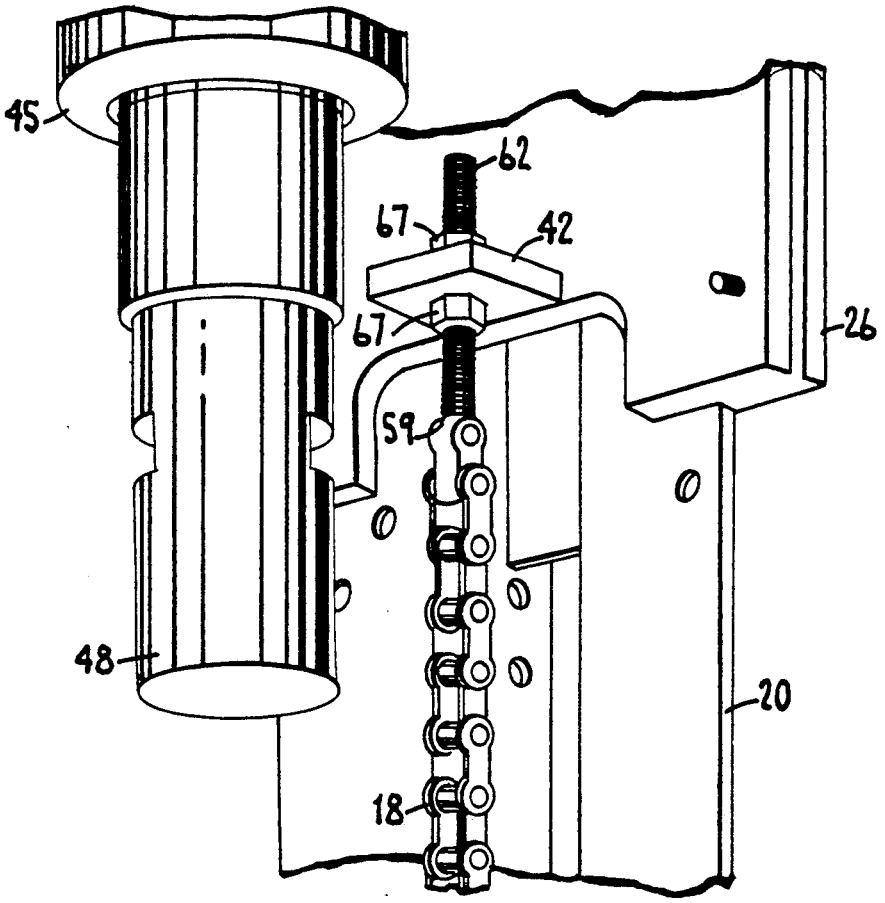
FIG. 4 is a close-up view of a means for attaching a chain to a plate means on the drilling apparatus.

The drilling apparatus has means for advancing and retracting the drill head over a span along the guide means. The means for moving includes an upper rotatable sprocket 32 and a lower rotatable sprocket 33 mounted along the span, for example at the upper and lower ends of the guide means, respectively. A length of roller chain 18 is looped around and engaged by teeth on the upper and lower sprockets. The length of chain has ends 58, 59 which are attached to the drill head such as by threaded fasteners 62 from opposite directions along the guide means. As shown in FIG. 4, one end of the threaded fastener 62 is threadedly engaged with the chain end 59. A portion of the fastener 62 extends through a hole in tab 42 attached to the plate means 26, and the fastener 62 is secured to the tab 42 by nuts 67. Tension in the chain 18 is adjustable by varying the portion of the fastener 62 which extends through the tab 42.

Figure 5:
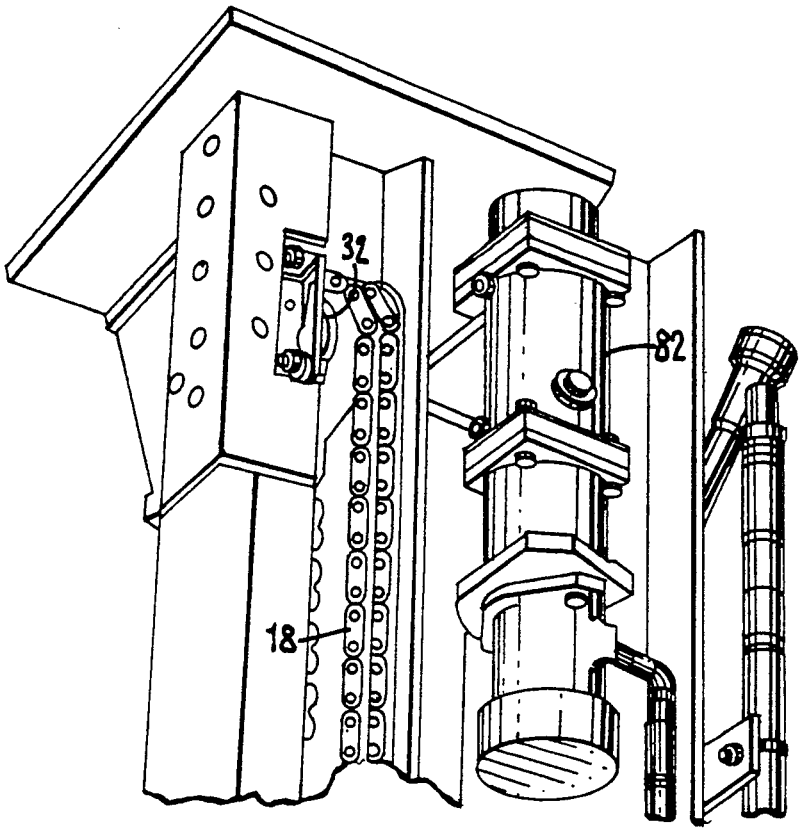
FIG. 5 is a close-up view of an upper sprocket of the drilling apparatus which is engaged to be driven by a hydraulic motor.

Means for rotating at least one of the upper and lower sprockets are also provided. The means for rotating may be a further hydraulic motor 82 which receives hydraulic forces from the vehicle via hydraulic hose means. The hydraulic motor 82 is preferably operable by controls disposed among the control valves 68. Rotating one of the upper and the lower sprockets via motor 82 exerts a force via the length of chain on the drill head. Thus, the drill head may be raised or lowered depending upon the direction of rotation of the sprockets and the resultant direction of the force exerted by the length of chain. In a preferred embodiment, as shown in FIG. 5, the motor 82 is a standard hydraulically operated gear reduction box such as is commonly known in the drilling industry. The motor 82 operates a drive unit which is mechanically engaged with the upper sprocket 32 to cause rotation of the upper sprocket upon the application of hydraulic forces to the motor 82.

During a drilling operation, the drill head is gradually lowered to advance the drill bit 56 into the ground. A great downward pressure can be exerted on the drill bit as a result of the hydraulic forces acting through the hydraulic motor 82 to urge rotation of the associated upper sprocket 32 and cause a high tension in the chain 18.

Figure 10A:
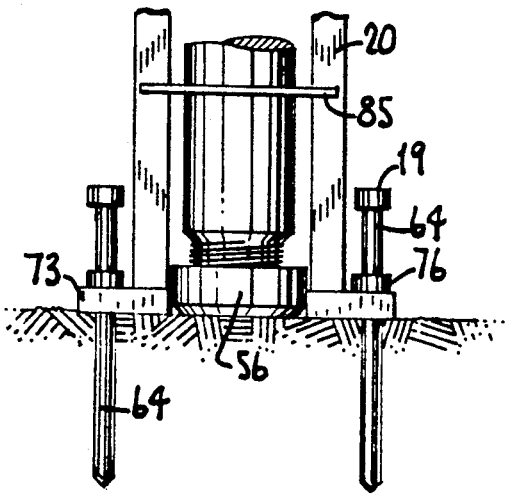
FIG. 10*a* is a view of a means for restraining a lower end of the drilling apparatus prior to penetration of a drill bit into the ground.
Figure 10B:
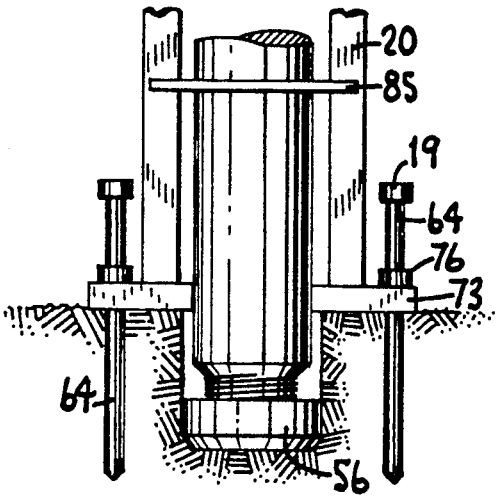
FIG. 10*b* is a view of the means for restraining after penetration of the drill bit into the ground, the lower end of the drilling apparatus being supported on the ground.
Figure 10C:
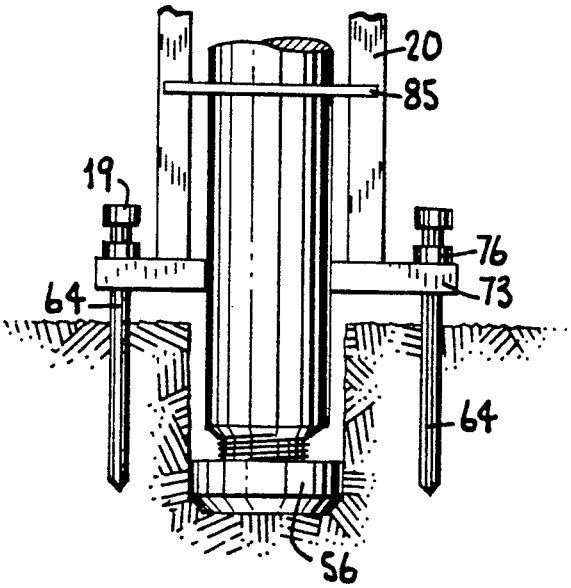
FIG. 10*c* is a view of the means for restraining after penetration of the drill into the ground, the lower end of the drilling apparatus floating along the pins above the ground.

The great downward pressure may cause the guide means 20 to "float" above the ground during a drilling operation. Referring now to FIG. 10*a*, the stabilizer bar 73, which is attached to the lower end of the guide means, is supported on the ground prior to starting a drilling operation. Pins 64 which are approximately 36 inches long are inserted through the sleeves 76 into the ground. The pins 64 may optionally have a head 19, but it is preferable that the head 19 be disposed a distance above the sleeve 76 when the drilling apparatus is at rest, whereby a length of the pin 64, e.g., approximately 18 inches, extends above the sleeve 76. Upon applying downward pressure on the drill bit 56 the drill bit will advance into the ground. If a tip portion of the ground is soft or loose earth, the downward pressure will be relatively small, and the stabilizer bar 73 will remain in contact with the ground surface, as shown in FIG. 10*b*. When the drill bit 56 contacts hard material such as rock, the downward pressure on the drill bit may be increased sufficiently to "float" the guide means 20 having the stabilizer bar 73 on the pins 64, as shown in FIG. 10*c*. Flotation of the stabilizer bar above the ground surface is an indication to operating personnel that they have achieved a practical upper limit of downward pressure on the drill bit 56. For applying maximum downward pressure on the drill bit 56, it is preferred that the stabilizer bar float approximately 2–6 inches above the ground surface. Flotation of the stabilizer bar also relieves stress and vibration on the vehicle boom.

The drilling apparatus may further include a drill bit guide 85 attached to the guide means for preventing deflection of the drill bit relative to the plate 26 especially when starting the hole in the ground. The drill bit guide 85 is formed by a plate which is attached to the guide means in a plane substantially perpendicular to the drill pipe, and is preferably attached at the lower end of the guide means in the vicinity of the percussion tool 63. The drill bit guide defines a hole having a diameter which is sufficient to permit rotation of the percussion tool therein, while providing a minimal clearance around the periphery of the percussion tool for retaining alignment of the percussion tool. Deflections of the drill bit are resisted by contact between the percussion tool and an inside edge of the drill bit guide. The drill bit guide is described in U.S. Pat. No. 3,370,285 to Andersen et al., which is incorporated herein by reference.

The invention having been disclosed, variations and additional embodiments in accordance with the invention will now become apparent to persons skilled in the art. Reference should be made to the appended claims rather than the foregoing specification to assess the scope of the invention in which exclusive rights are claimed.

We claim:

1. Earth drilling apparatus for use with a vehicle for performing hole drilling operations, the vehicle having an elongated structure attached at an inner end to the vehicle, and having a maneuverable outer end, and means for providing hydraulic forces to the apparatus through hydraulic fluid couplings, the earth drilling apparatus comprising:

an elongated guide means defining an elongation direction;

means for rotatably attaching an upper end of the guide means to the elongated structure, whereby the guide means is rotatable relative to the elongated structure on an axis extending parallel to the elongation direction;

plate means movably attached along at least a portion of the guide means;

a drill head attached to the plate means, the drill head comprising at least one hydraulic motor for producing operative movement of a body;

means for communicating the hydraulic forces from the vehicle to the drill head;

means for moving the plate means along the at least a portion of the guide means;

a drilling tool attached to the drill head and oriented to drill a hole as the drill head is moved toward a ground surface; and, means for restraining a lower end of the guide means to the ground surface to resist transverse and rotative movement of the guide means.

2. The drilling apparatus according to claim 1, wherein the means for rotatably attaching includes an upper coupling member attached to the elongated structure, and a lower coupling member attached to the upper end of the guide means, the upper and lower coupling members being relatively rotatable on a shaft, one of the upper and lower coupling members defining a plurality of apertures concentric with the shaft, the other of the upper and lower coupling members having a rod selectively engageable in the plurality of apertures such that relative rotation of the coupling members is prevented, and means for selectively engaging the rod in the plurality of apertures.

3. The drilling apparatus according to claim 1, wherein the means for rotatably attaching further comprises means for pivotably attaching the upper end of the guide means to the elongated structure.

4. The drilling apparatus according to claim 3, wherein the guide means is attached to the elongated structure exclusively at the upper end, whereby a lower end of the guide means is positionable beyond an obstruction in a vicinity of the vehicle.

5. The drilling apparatus according to claim 3, wherein the means for pivotably attaching comprises a pair of spaced apart ear members extending from the upper end of the guide means, the ear members defining holes adapted to coaxially align with a bore on the elongated structure for mutually receiving a shaft therethrough.

6. The drilling apparatus according to claim 1, wherein the means for moving the plate means comprises an upper rotatable sprocket mounted at the upper end of the guide means, a lower rotatable sprocket mounted at the lower end of the guide means, a length of roller chain engaged around the upper and lower sprockets, the length of roller chain having ends attached to the plate means, and means for rotating at least one of the upper and lower sprockets.

7. The drilling apparatus according to claim 6, wherein the means for rotating comprises a hydraulic motor, and means for communicating the hydraulic forces from the vehicle to the hydraulic motor.

8. The drilling apparatus according to claim 1, wherein the means for restraining comprises a stabilizer attached to the lower end of the guide means, the stabilizer defining anchoring holes for receiving pins to be driven through the anchoring holes into the ground whereby the guide means can float above the ground along a length of the pins when the drilling tool exerts a pressure on the ground.

9. The drilling apparatus according to claim 1, wherein the means for communicating comprises hydraulic hose means attached at one end to the hydraulic fluid couplings on the vehicle, and at an other end to the drill head.

10. The drilling apparatus according to claim 9, further comprising control means attached to the guide means for controlling the hydraulic forces to the drill head.

11. The drilling apparatus according to claim 1, wherein the plate means is an integral part of the drill head.

12. The drilling apparatus according to claim 1, wherein the drilling tool is a drill bit, and the drill head is operable to rotate the drill bit.

13. The drilling apparatus according to claim 1, further comprising a percussion tool attached between the drill head and the drilling tool.

14. Earth drilling apparatus comprising:

a vehicle having means for providing hydraulic forces through hydraulic fluid couplings;

an elongated structure attached at an inner end to the vehicle, and having a maneuverable outer end;

an elongated guide means defining an elongation direction and rotatably attached at an upper end to the elongated structure, whereby the guide means is rotatable relative to the elongated structure on an axis extending parallel to the elongation direction;

plate means movably attached along at least a portion of the guide means;

a drill head attached to the plate means, the drill head comprising at least one hydraulic motor for producing operative movement of a body;

means for communicating the hydraulic forces from the vehicle to the drill head;

means for moving the plate means along the at least a portion of the guide means;

a drilling tool attached to the drill head and oriented to drill a hole as the drill head is moved toward a ground surface; and means for restraining a lower end of the guide means to resist transverse and rotative movement of the guide means.

15. The drilling apparatus according to claim 14, wherein the means for rotatably attaching includes an upper coupling member attached to the elongated structure, and a lower coupling member attached to the upper end of the guide means, the upper and lower coupling members being relatively rotatable on a shaft, one of the upper and lower coupling members defining a plurality of apertures concentric with the shaft, the other of the upper and lower coupling members having a rod selectively engageable in the plurality of apertures such that relative rotation of the coupling members is prevented, and means for selectively engaging the rod in the plurality of apertures.

16. The drilling apparatus according to claim 14, wherein the means for rotatably attaching further comprises means for pivotably attaching the upper end of the guide means to the elongated structure.

17. The drilling apparatus according to claim 16, wherein the guide means is attached to the elongated structure exclusively at the upper end, whereby a lower end of the guide means is positionable beyond an obstruction in a vicinity of the vehicle.

18. The drilling apparatus according to claim 16, wherein the means for pivotably attaching comprises a pair of spaced apart ear members extending from the upper end of the guide means, the ear members defining holes adapted to coaxially align with a bore on the elongated structure for mutually receiving a shaft therethrough.

19. The drilling apparatus according to claim 14, wherein the means for moving the plate means comprises an upper rotatable sprocket mounted at the upper end of the guide means, a lower rotatable sprocket mounted at the lower end of the guide means, a length of roller chain engaged around the upper and lower sprockets, the length of roller chain having ends attached to the plate means, and means for rotating at least one of the upper and lower sprockets.

20. The drilling apparatus according to claim 14, wherein the means for restraining comprises a stabilizer attached to the lower end of the guide means, the stabilizer defining anchoring holes for receiving pins to be driven through the anchoring holes into the ground whereby the guide means can float above the ground along a length of the pins when the drilling tool exerts a pressure on the ground.

* * * * *